US007503163B2

(12) United States Patent
Deffner

(10) Patent No.: US 7,503,163 B2
(45) Date of Patent: Mar. 17, 2009

(54) CHAIN

(76) Inventor: Karin Deffner, Lehenpointstrasse 31, Bavaria (DE) 83730

( * ) Notice: Subject to any disclaimer, the term of this patent is extended or adjusted under 35 U.S.C. 154(b) by 0 days.

(21) Appl. No.: 11/817,117

(22) PCT Filed: Feb. 23, 2006

(86) PCT No.: PCT/EP2006/001655

§ 371 (c)(1),
(2), (4) Date: Nov. 28, 2007

(87) PCT Pub. No.: WO2006/089745

PCT Pub. Date: Aug. 31, 2006

(65) Prior Publication Data

US 2008/0148705 A1 Jun. 26, 2008

(30) Foreign Application Priority Data

Feb. 24, 2005 (DE) ..... 10 2005 008 459

(51) Int. Cl.
*B21L 5/02* (2006.01)
*B68B 1/04* (2006.01)

(52) U.S. Cl. ..... 59/80; 59/93; 59/35.1; 54/6.1

(58) Field of Classification Search ..... 54/6.1; 59/35.1, 80, 93
See application file for complete search history.

(56) References Cited

U.S. PATENT DOCUMENTS

| | | | | | |
|---|---|---|---|---|---|
| 2,196,686 | A * | 4/1940 | Stahl | 59/35.1 |
| 3,181,257 | A * | 5/1965 | Larsen | 37/398 |
| 4,798,043 | A * | 1/1989 | Wyse | 54/6.1 |
| 5,542,244 | A * | 8/1996 | Chia et al. | 59/35.1 |
| 5,682,736 | A * | 11/1997 | Chia et al. | 59/35.1 |
| 6,892,521 | B2 * | 5/2005 | Rosenwasser et al. | 59/35.1 |
| 7,207,162 | B2 * | 4/2007 | Deffner | 54/6.1 |

FOREIGN PATENT DOCUMENTS

| | | | |
|---|---|---|---|
| DE | 103 16 525 | A1 * | 10/2004 |
| WO | 2004/089809 | A1 | 10/2004 |

* cited by examiner

*Primary Examiner*—David B Jones
(74) *Attorney, Agent, or Firm*—Christopher Paradies; Fowler White Boggs P.A.

(57) ABSTRACT

A chin chain for bits/bridles for use on a horse (for example, curb bit), includes a first chain element turning out to the left and a second chain element turning out to the right, the chain elements connected by a connecting element. In one example, the connecting element is formed from one piece and engages at least two links of the first chain element turning out to the left and at least two links of the second chain element turning out to the right.

16 Claims, 6 Drawing Sheets

CHAIN

REFERENCE TO RELATED APPLICATIONS

This application claims the benefit of the filing date of German Patent Application No. 10 2005 008 459.1 filed Feb. 24, 2005, the disclosure of which application is hereby incorporated herein by reference.

FIELD OF THE INVENTION

The field relates to a chain or a chin chain.

BACKGROUND OF THE INVENTION

A bridle such as a curb bridle allows the advanced rider to give finer aids on an appropriately trained horse. In the bridle of trained dressage horses, the curb typically comprises two bits—snaffle and curb—so that the rider must handle two pairs of reins simultaneously. The chin chain typically used currently in a curb bridle comprises multiple interlocking oval rings. A small round ring located in the middle of the chin chain, called a lip strap ring, was historically used for fastening the so-called lip strap (currently practically without significance). The lip strap for curb chin chains prevents the lower trees of the curb from getting too close to the mouth gap with loose reins and the horse being able to capture and hold these using his lips. The lip strap additionally ensures a correct effect of the chin chain at the correct point. The chin chain, which is always to be twisted to the right, is suspended in the right and left chin chain hooks of the curb, from the inside on the right side and from the outside on the left side. Its correct bending and/or flexibility is of significant influence on good bridling and effect.

The chin chains currently typically used for curbs are one-piece chains, to be twisted to the right, of the double round curb chain type. The curb chain is a chain type known in jewelry production, which is one of the so-called eye chains (or link chains). The basic type of the eye chain is the anchor chain, in which lying and standing eyes alternate. In contrast thereto, the curb chain comprises eyes or links uniformly lying flat, namely round or oval eyes or links twisted to the right. The twisting of the individual links causes the entire chain to have a rotational direction.

In detail, a chain twisted to the right comprises links which, in contrast to normal flat, round, or oval shaped chain links (as in an anchor chain, for example), are shaped in such a way that in the twisted state, they uniformly run together and/or interlock and thus allow the neighboring chain links not to stand perpendicularly to one another under tensile stress (as in the anchor chain, in which standing and lying links are situated alternately), but rather as flat as possible, in the ideal case in a line pressing against one another. A chain is thus obtained which has a flat surface, in the ideal case having a width corresponding to the width of the links, and which may adapt itself pressing flat and flexibly in all directions to a round surface, such as the chin of a horse. In jewelry production, one differentiates further between flat curb chains and round curb chains.

In the maximally flat state, which is thus maximally twisted to the right, i.e., in a state twisted maximally into itself in a right rotation, the chain may no longer be twisted further into itself to the right. I.e., the chain blocks further rotation to the right, i.e., it is closed in this direction. The chain opens in a left rotation, but leaves its maximum flat state. If the chain ends are fixed in the twisted state, as is the case when the chain is hung in the curb in the twisted state, the chain may no longer twist and maintains its flat, twisted state. Depending on how the links of the chain are shaped, the chain may also be overrotated beyond the maximum flat and twisted state, i.e., twisted further into itself. In the scope of the chain, twisted state means that the chain is maximally flat, i.e., is not overrotated if possible.

These chin chains, whose linkage of the individual links is oriented identically over the entire chain length, causes an uneven tension on both sides of the curb, however. Due to this varying force action, varying lever action on the curb rod in the mouth of the horse is achieved. More pressure is exerted on the interdental space and on the lips on the right than on the left. The uneven tension also causes the left chin chain hook to be drawn away from the mouth of the horse and the right chin chain hook to be drawn toward the mouth of the horse. Simultaneously, the effects on the mouth of the horse due to the differing lever effect on the curb rod—more pressure on the interdental space and lips on the right than on the left—are to be observed. This may result in tongue flaws, such as pushing out the tongue. Effects on the right corner of the mouth due to the tension inward on the right chin chain book are also to be observed. This is frequently to be observed from a lip hanging on one side on the right side of the mouth of the horse. In addition, this frequently results in injuries to the corner of the mouth.

WO 04/089809 discloses a two-part chin chain, which has a first chain element and a second chain element, the chain links each being linked opposite (turning out to the left and turning out to the right) in the first chain element and the second chain element. It is described that in this way a force which is exerted on the chin chain is dissipated uniformly onto the left side and the right side of the curb. A differing lever effect on one side, namely the increased pressure to the right on the curb rod, is thus precluded. In addition, the tension inward on the right chin chain hook is thus compensated for or canceled out. This chin chain advantageously counteracts a lip hanging on one side, injuries on the corner of the mouth, and tongue flaws.

The chain described has the disadvantage that it is to be used in connection with a commercially available rubber underlay, into which the twisted chain is inserted. Only in this way may be twisted and flat state be maintained and/or twisting of the individual chain links be suppressed, and thus also injury to the horse by the twisted chain links may be avoided.

As described above, commercially available chains which only have one rotational direction may not twist opposite thereto when they are hung twisted. The chain is locked by the suspension. In two-part chains having right and left rotation, such locking is lacking, because the chain is no longer fixed by the rotational direction reversal, it may twist even when its ends are fixed.

As indicated in FIG. 1, the right chain element (4) is open for one rotational direction and blocked or closed for the opposite direction, and the left chain element (2) is open and blocked or closed precisely in reverse. The chain twists easily when it is moved or shaken, or overturned entirely when it is prevented from twisting in regard to its individual links by a rubber underlay.

SUMMARY OF THE INVENTION

One object of providing a chain is to overcome the disadvantages of the known two-part chain.

This object may be achieved by the embodiments of the chain.

The chain according to one example, has a first chain element and a second chain element, the chain elements each being linked opposite (once turning out to the left and once turning out to the right) in the first chain element and the second chain element. The two chain elements are connected by a connection element which connects the chain element turning out to the right and the chain element turning out to the left and engages in a number of the links of the particular chain element which corresponds to the number of the following links in which a link of this chain element engages, and is shaped in such a way that it favors a configuration of the chain elements (2 and 4) in the twisted state in one plane as much as possible. This configuration is preferably favored by a shape of the connection element which is designed in such a way that the connection element and the links of the chain elements (2 and 4), in which the connection element engages, come into contact at an angle of 90° to one another under tensile stress in this configuration. The links of the chain elements (2 and 4) are preferably designed in such a way that they favor the configuration of the chain elements (2 and 4) in the twisted state. This is preferably caused in that the links are shaped in such a way that they come into contact at an angle of 90° with one another in this configuration under tensile stress.

In one embodiment, a weight is attached in the middle area of this chain in such a way that this weight acts against twisting of the individual chain links and tilting of the entire chain when the chain is completely twisted and the chain ends are locked. The weight may be caused by an additional ring which is attached on one side to the connection element, or by the connection element itself being heavier on one side than the other, or by both.

In another embodiment of the chain, the chain is further stabilized by a rigid connection element. A weight may also be attached in this embodiment in such a way that this weight also acts against twisting of the individual chain links and tilting of the entire chain when the chain is completely twisted and the chain ends are locked. In a further alternative embodiment, at least two two-part chains are linked to one another longitudinally, such that in each case one twisted chain element which turns out to the right of a first chain is linked longitudinally with a twisted chain element which turns out the left of a second chain or a one-part twisted chain which turns out to the right is linked longitudinally to a one-part twisted chain which turns out the left. The linked chains mutually prevent twisting and tilting in this embodiment. All chains may be used in this embodiment.

The chains may be used as chin chains for all possible forms of bridles, in particular for dressage, jumping, post, elbow, and Liverpool bits, hackamore, and Pelham, as well as travel chin chains, travel chin chains for ponies, and double and single chin chains having leather attachment. In one example of the chain, these are curbs or bridles like curbs.

However, the chains may also be used for other purposes, for example, in jewelry production or as force-transmitting means in machines.

DETAILED DESCRIPTION

Figure 1:
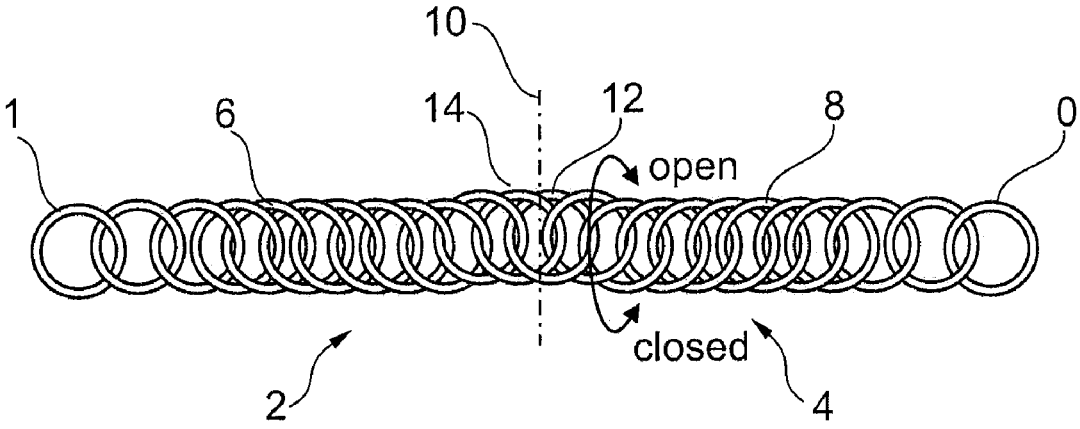
FIG. 1 shows a three-dimensional view of a chin chain having a first chain element 2 twisted to the left and a second chain element 4 twisted to the right.

The examples described and the drawings rendered are illustrative and are not to be read as limiting the scope of the invention as it is defined by the appended claims. FIG. 1 shows an example of a two-part chain, which comprises a first chain element 2 and a second chain element 4. The first chain element 2 comprises multiple first links 6. The second chain element 4 comprises multiple second links 8. As may be inferred from FIG. 1, the first links 6 of the first chain element 2 are linked to the left, i.e., twisted to the left, and the second links 8 of the second chain element 4 are linked to the right, i.e., twisted to the right.

The reference numeral 10 identifies a line of symmetry of the chain. If one observes the right part of the chain, comprising the chain element 4, this right part of the chin chain corresponds to a traditional chin chain. In contrast to the traditional chin chain, however, the left part, i.e., the part left of the line of symmetry 10, is designed having linkage in the opposite linkage direction. The area to the right of the line of symmetry 10 thus has a linkage twisted to the right, while in contrast the area to the left of the line of symmetry 10 has a linkage twisted to the left.

A connection element, comprising the connection rings 12 and 14, is provided in the middle of the chain, i.e., in the area of the line of symmetry 10, to connect the first chain element 2 to the second chain element 4. Furthermore, links 0 and 1 are provided at the ends of the first chain element 2 and the second chain element 4, which are to be hung in the hooks of the curb. The two rings 12 and 14 which represent the connection element engage in two links (6, 20, 22, 24, 26) of the first chain element (2) twisted to the left and two links (8, 30, 32, 34, 36) of the second chain element (4) twisted to the right and are shaped in such a way that they favor a configuration of the chain elements in the twisted state as much as possible, preferably precisely in one plane.

If one observes the chain elements 2 and 4 individually and conceives of locking the chain in the middle, the first chain element 2 would no longer be twisted further to the left. This chain element is open to the right. The chain element 4 may no longer be twisted further to the right, the chain is open to the left. However, if the chain ends 0 and 1 are locked and the middle is flexible, as in the hung state, for example, the locking is canceled out due to the rotational direction reversal in the middle and the entire chain may be twisted or tilted upward starting from the middle. The arrow in FIG. 1 indicates the open and closed sides of the entire two-part chain. In the open direction, the chain may tilt and twist. The chain is stabilized against twisting or tilting by the connection element, which favors the configuration of the chain element in the twisted state in one plane as much as possible.

A preferred type of linkage will now be described further with reference to FIGS. 2, 3, 4, and 5.

Figure 2:
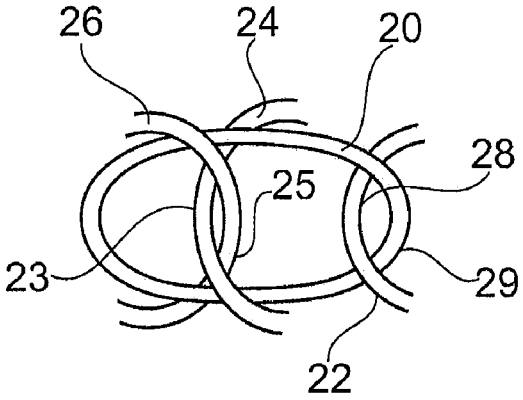
FIG. 2 shows a top view of a link of a first chain element.
Figure 3:
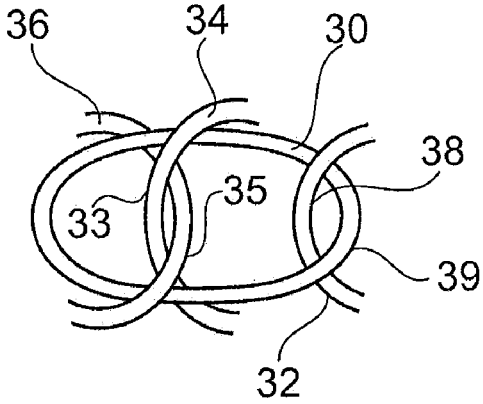
FIG. 3 shows a top view of a link of a second chain element.

FIG. 2 shows a top view of a link 20 of the first chain element 2 and FIG. 3 shows a top view of a link 30 of the second chain element 4. The type of linkage will be described on the basis of FIG. 3.

As shown in FIG. 3, three neighboring links 32, 34, and 36 are hung in the link 30. The links 32 and 34 extend to the right and the link 36 extends further to the left. The link 32 is hung in the link 30 in such a way that an end area 38, which may be provided with a thickened area, comes into contact directly with an end area 39 of the link 30 in the event of load. The link 34 is also hung in the link 36. In the event of load of the links 34 and 36, an area 35 of the link 36, which is designed as an end area and may possibly have a thickened area, presses against an end area 33 of the link 34, which may also have a thickened area. The link 32 is hung in the link 30 in such a way that the upper area of the link 32 goes above the link 30, while in contrast the lower area of the link 32 passes through below the link 30. The link 34 is hung in the link 30 and the link 36 in such a way that an upper area of the link 34 goes above the link 30 and the link 36, and the lower area of the link 34 goes through below the link 36 and below the link 30. In this type of linkage, a link engages in two following links.

Similarly as in FIG. 3, in FIG. 2, three links 22, 24, and 26 are hung in the link 20, but precisely mirror-reversed. A linkage twisted to the right is obtained by this special type of interlocking in the case of FIG. 3 and a linkage twisted to the left is obtained in the case of FIG. 2. Only chains twisted to the right, as schematically shown in FIG. 3, are commercially available.

Those skilled in the art know the greatly varying possibilities of the linkage twisted to the right according to the type described above. For example, the links may only engage in one following link, so that a coarser-mesh, looser chain results. This particularly applies for the two links of the chain lying furthest to the outside in FIG. 1. This type of linkage is referred to in the following as single-link linkage. The links may, as described in detail above and shown in FIGS. 1 through 3 (with the exception of the particular to outlying links in FIG. 1), however, also engage in two following links (e.g., double round curb chains) or also, not shown in the figures, in three or more of the following links, so that finer-mesh, denser chains result. These linkages are referred to as double-link, triple-link, etc. linkages for the purpose of the present invention depending on how many neighboring links are engaged in. These various possibilities of linkage according to the type described here may be used uniformly for the chain elements twisted to the right and the left.

The links may assume greatly varying shapes, e.g., oval, round, or also ellipsoidal. Polygonal links are also conceivable. The links also do not have to be uniformily thick, but rather may contain thickened areas and recesses. The thickened areas may also originate from weld seams or hard solder bonds. An example of a chain having links which have thickened areas and recesses is the curb chain often used in the jewelry industry. All links described may be used in connection with the various possibilities for linkage described above.

Figure 4:
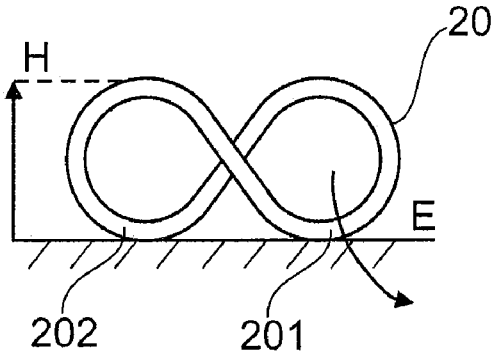
FIG. 4 shows a link from FIG. 2 in a side view.
Figure 5:
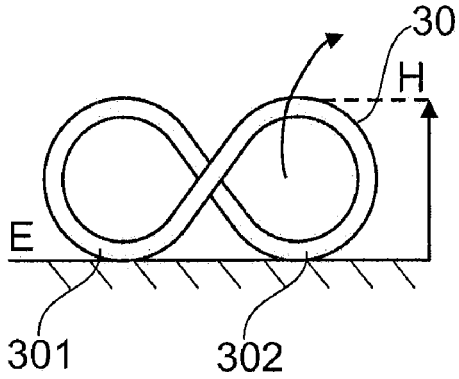
FIG. 5 shows a link from FIG. 3 in a side view.

FIG. 4 shows a side view of a possible shape of a link 20 from FIG. 2 and FIG. 5 shows the mirror-image link 30 from FIG. 3. The principle of the links for chains twisted to the right and chains twisted the left may be explained well on the basis of this link shape.

As may be inferred from FIG. 4, the link 20 is twisted into itself to the left. This is indicated by the arrow in FIG. 4. This may also be described in other words as follows:

A link 20 which is not twisted in the side view, i.e., is flat, may be a starting link. This flat link 20 has a plane and would lie planar on plane E. The link 20 is then twisted in such a way that only two areas 201 and 202 still lie on the plane E. In the areas in which the link does not rest, a neighboring link 22, 24, and 26 may be guided through, without the link 20 having to change its position to the plane E.

The shape is preferably selected in such a way that the chain links at least have a height H which is sufficient so that in a first chain element (2) twisted to the left, comprising multiple links (20). These links (20) do not mutually interfere in their position to the plane and rest on the plane E at their particular two points (201, 202). In one example, the links are designed in such a way that they favor the twisted state of the chain element formed thereby. This is preferably caused in that the links of the chain element come into contact an angle of 90° with one another in the twisted state and under tensile stress.

This also applies for the link 30 in FIG. 5, except that it is bent in the other direction, away from the observer, and is thus shaped in a mirror image in comparison to link 20 from the observer. The mirror image reflection may result from the perspective of the observer or may be caused by a chiral structure and thus independently of the perspective of the observer.

Depending on how strongly the links are bent, the height H of the links changes when they lie on the plane E. Preferably, links which are as low as possible, i.e., flat links, which are only bent far enough that they do not mutually interfere in their position on the plane E in the linkage. A chain which is as stable as possible is thus obtained, which has little play between the chain links and may no longer be twisted much further in its closed direction or overrotated beyond the maximum flat configuration or in the twisted state. In one embodiment, the chain links are designed in such a way as when one twists rings lying planar on a plane (E) into themselves and the links thus only rest on the plane (E) at two points, and the chain links at least have a height H which is sufficient so that the chain links of the first chain element (2) twisted to the left or of the second chain element (4) twisted to the right rest on the plane E at their particular two points (201, 202 or 301, 302) in the twisted state of the chain elements, without mutually interfering, and come into contact at an angle of 90° with one another in the twisted state in the end areas (23, 25, 28, 29 or 33, 35, 38, 39). This angle causes the chain elements not to have any twist in one direction even under tensile stress. A vertically hanging chain element then hangs loosely in the twisted state, without twisting into itself. If a connection element is used, which favors the configuration of the chain elements in the twisted state precisely in one plane, the chain is further stabilized against twisting or tilting. Such a chain, comprising a chain element twisted to the right and a chain element twisted to the left and a connection element as described above, hangs loosely vertically in the twisted state, without twisting by itself.

A uniform lever effect of the curb rod in the mouth of the horse is advantageously achieved by the chin chain illustrated in FIGS. 1 through 5, so that the pressure on the interdental space and the lips on the right is equal to the pressure on the interdental space and the lips on the left. Simultaneously, a force effect which is equal on both hooks on the curb is thus also made possible. In addition, in the event of load of the chin chain, the load is dissipated uniformly onto both sides of the curb. A tongue flaw in the horse, a lip hanging on one side, and possibly injuries in the corner of the mouth are thus advantageously counteracted. In addition, a pain stress of the horse is significantly reduced.

According to one embodiment, the chin chain comprises a first chain element (2) twisted to the left and a second chain element (4) twisted to the right, the first chain element (2)

comprising at least two first links (6, 20, 22, 24, 36) and the second chain element (4) comprising at least two links (8, 30, 32, 34, 36), with the first chain element (2) twisted to the left and the second chain element (4) twisted to the right being connected by a connection element (40, 50, 60, 70, 70', 70"). The connection element (40, 50, 60, 70, 70', 70") may engage at least in a number of the links (6, 20, 22, 24, 26) of the first chain element (2) twisted to the left and the number of the links (8, 30, 32, 34, 36) of the second chain element (4) twisted to the right which corresponds to the number of the neighboring elements such that a link of a chain element of the chain engages and is shaped in such a way it favors a configuration of the chain elements (2 and 4) in the twisted state in one plane as much as possible, which is referred to herein as "stacked planarly." Preferably, the chain links are linked "double-linked," i.e., one link engages in two neighboring links, and the connection element accordingly engages in two links of the chain elements in each case.

Figure 6:
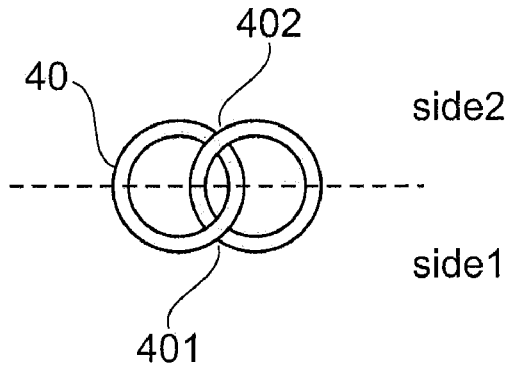
FIGS. 6 through 8 show three-dimensional views of various connection elements.

FIG. 6 shows a three-dimensional view of a connection element in one example. The connection element comprises two rings, which are solidly connected to one another at two points (401, 402), one ring, which engages in at least one link of the chain element (2) twisted to the left, being designed like a link (6, 20, 22, 24, 26) of the chain element (2) twisted to the left, and the other ring, which engages in at least one link of the chain element (4) twisted to the right, being designed like a link (8, 30, 32, 34, 36) of the chain element (4) twisted to the right. Alternatively, the connection element of this embodiment may also comprise two rings as described above, which are only connected to one another at one point.

In one example, the connection element may be designed in such a way that the rings are merged with one another at the connection points in such a way that it is no longer recognizable that the connection clement has been shaped from originally independent rings. Furthermore, the element may be molded identically in one piece.

Figure 7A:
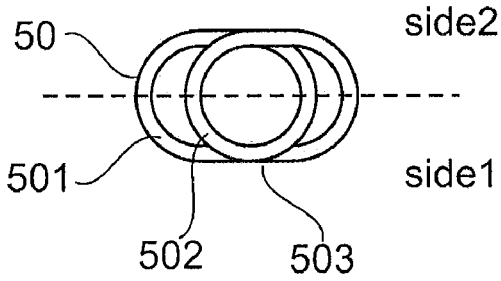
Figure 7B:
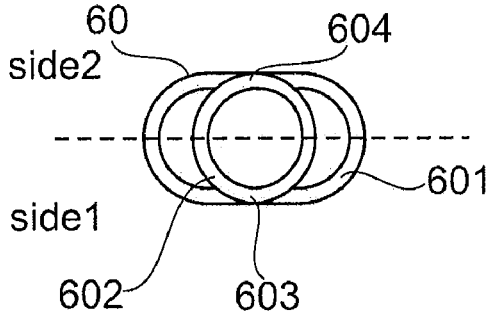
Figure 14:
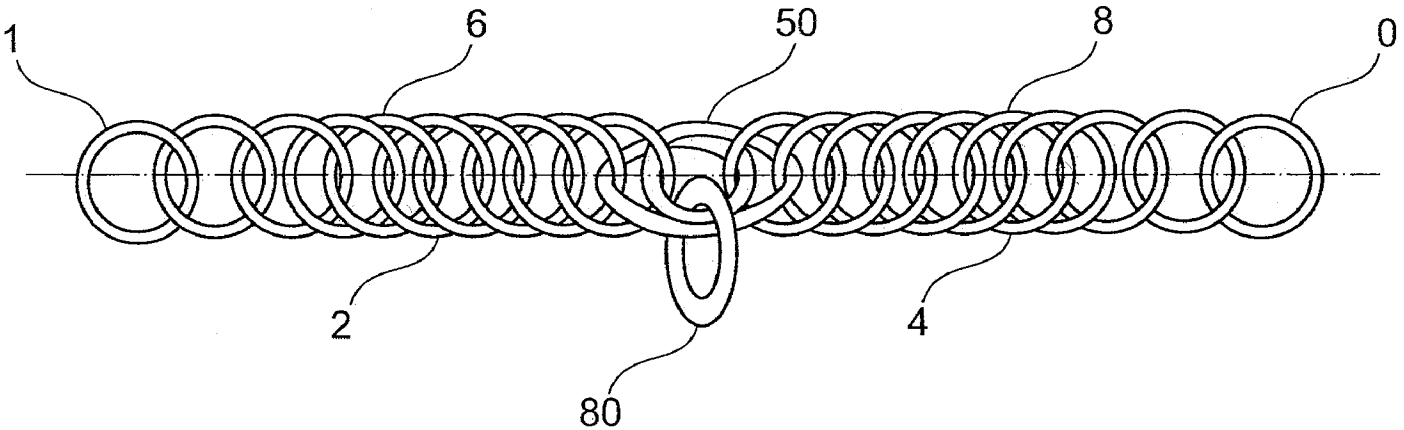
FIG. 14 shows a three-dimensional view of a chain.
Figure 15:
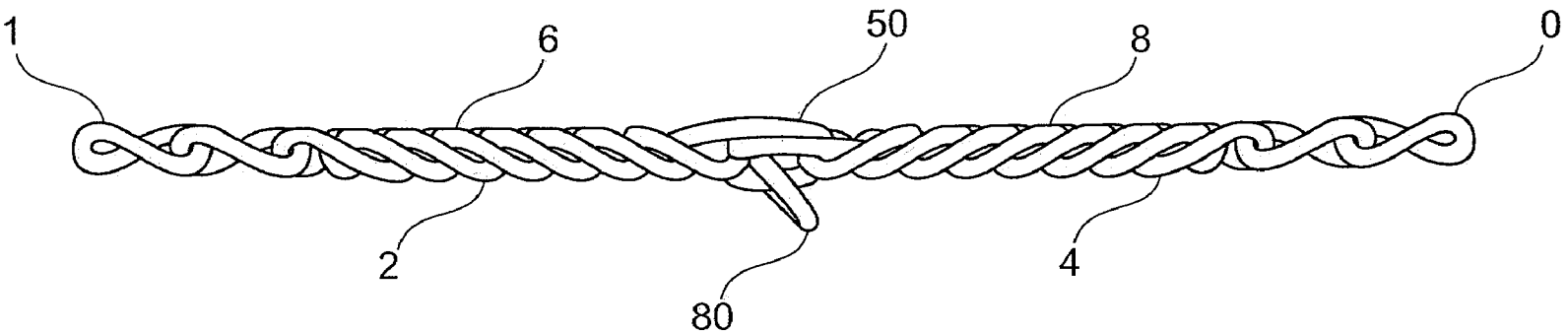
FIG. 15 shows a three-dimensional side view of the chain in FIG. 14.

FIGS. 7*a* and 7*b* show further examples of connection elements. These connection elements comprise an oval (501, 601) and around ring (502, 602) fitted into the oval. Advantageously, as shown in FIG. 7*a*, the connection element may be shaped from a ring according to one embodiment, which forms a large oval loop and a smaller round loop by twisting by 180°, which are laid one on top of another, so that the small round loop comes to rest largely above the large oval loop. FIGS. 14 and 15 show a chain in which such a chain element is inserted. Furthermore, as shown in FIG. 7*b*, an independent oval and a ring may also be connected to one another. The small ring may also be fitted in the oval instead of being laid on the oval. The ring and the oval are solidly connected to one another at at least one point. The finished connection element may also be merged here in such a way that the type of meshing is no longer recognizable. Furthermore, the element may be molded identically in one piece.

Figure 8:
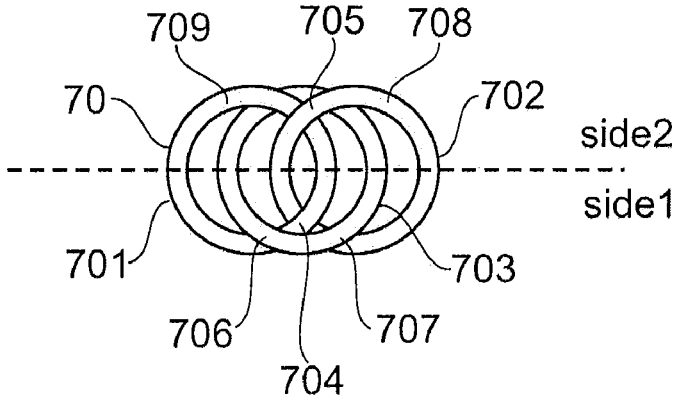

FIG. 8 shows a further example of connection element, which is shaped from three rings (701, 702, 703). In this case, a first ring (701) and a second ring (702) engage in one another and a third ring (703) engages in both rings (701, 702). The first ring (701) and the second ring (702) are shaped like links of the chain elements and are solidly connected to one another at two points in such a way that they stand in relation to one another like a link (8, 30, 32, 34, 36) twisted to the right and a link (6, 20, 22, 24, 26) twisted to the left. The third ring (703) is substantially flat and is solidly connected to the first ring (701) and the second ring (702) as centrally as possible in relation to the first and second rings in such a way that it lies in the position which is closest to a parallel position to the plane when the first and second rings rest on a plane E. Preferably, the third ring (703) is solidly connected to the first ring (701) and the second ring (702) at four points (706, 707, 708, 709). More preferably, the first ring (701) and the second ring (702) are connected to one another in such a way that still a fourth ring (80) may be passed between their two connection points (704, 705). Here as well, the finished connection element may be merged in such a way that the type of meshing is no longer recognizable. Furthermore, the element may be molded identically in one piece. Alternatively, the third ring (703) may also be loose.

In this embodiment, the chain element (4) twisted to the right engages in the side of the connection part on which the ring is which is designed like a link (8, 30, 32, 34, 36) twisted to the right, and the chain element (2) twisted to the left engages in the side of the connection part on which the ring is which is designed like a link (6, 20, 22, 24, 26) twisted to the left.

Preferably, the chin chain and the connection part are produced from brass, copper, stainless steel, or iron. V2A steel is preferred. However, the chain may also be produced from silver, gold, platinum, or any other conceivable precious medal, or from plastic, German silver, or Aurigan, which is an example of a copper alloy containing substantially no nickel. The chain may also be galvanized and subjected to any other mechanical posttreatment such as polishing.

Figure 10:
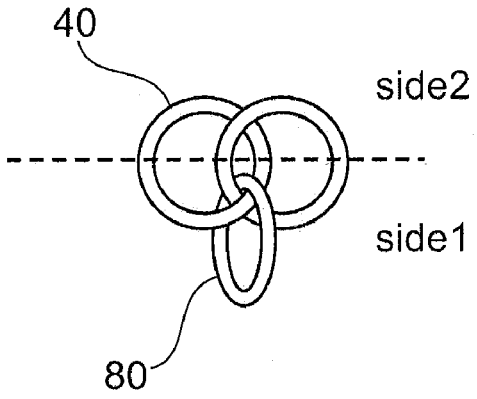
FIGS. 10 and 11 show three-dimensional views of various connection elements, which are weighted on one side by a ring.
Figure 11:
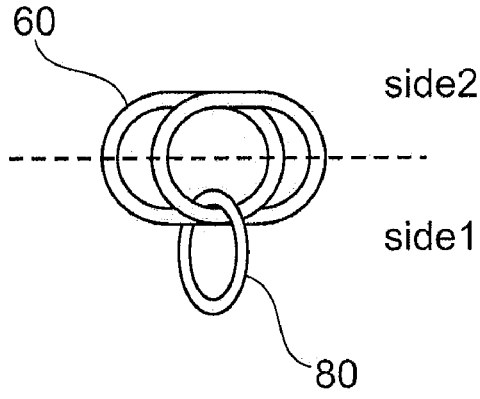

According to a further embodiment, the connection element according to the above embodiments weighs more on one side. This may be caused by an asymmetrical structure of the connection element or by the additional use of a heavier metal, such as lead. The one side may also be weighted by an additional ring, which engages in the middle of the connection part. The connection element is preferably constructed asymmetrically in such a way that it weights more on one side. FIGS. 10 through 12 show connection elements which are weighted by a further ring on one side.

Because the connection element is weighted on one side, the middle area of the two-part chain is fixed. In this embodiment, the chain is hung in such a way that the heavy side of the connection element lies in the twisted state on the side in which the chain may not rotate further. In FIG. 1, this is the side which is identified by the arrow as "closed". The weight may thus cause the chain not to tilt onto the "Open" side and also not to twist in the direction of the open side. Alternatively, the weight may also be attached centrally.

Figure 9:
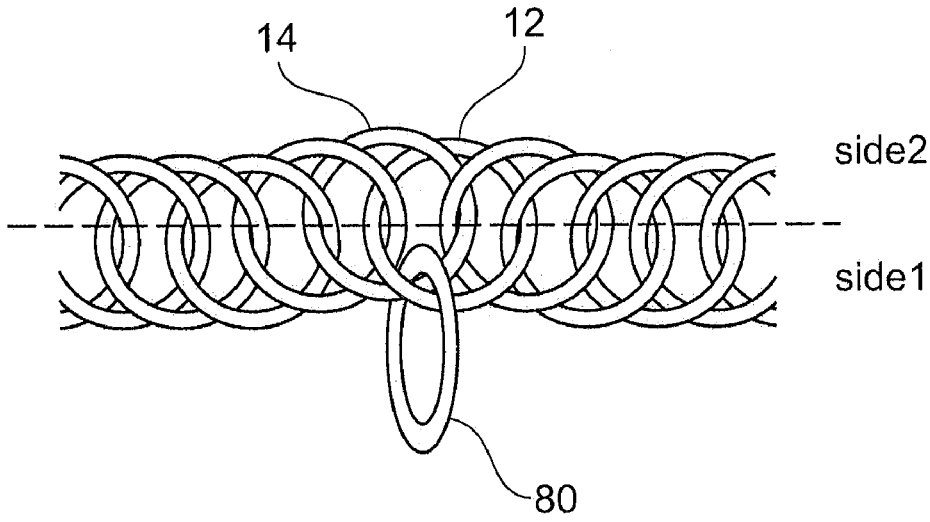
FIG. 9 shows a three-dimensional view of a two-part chain having a weight.

FIG. 9 shows a further embodiment. The chin chain comprises a first chain element (2) twisted to the left and a second chain element (4) twisted to the right here, the first chain element (2) comprising at least two first links (6, 20, 22, 24, 26) and the second chain element (4) comprising at least two second links (8, 30, 32, 34, 36) and the chain being weighted on one side in the middle area. A special connection element is provided here. The connection element may, for example, comprise two independent rings which interlock in one another and in the adjoining chain elements, which favor a configuration of the two chain elements in one plane. Preferably, the weight is attached in the form of a further ring (80). FIGS. 10 and 11 show connection elements having one ring (80).

Figure 12A:
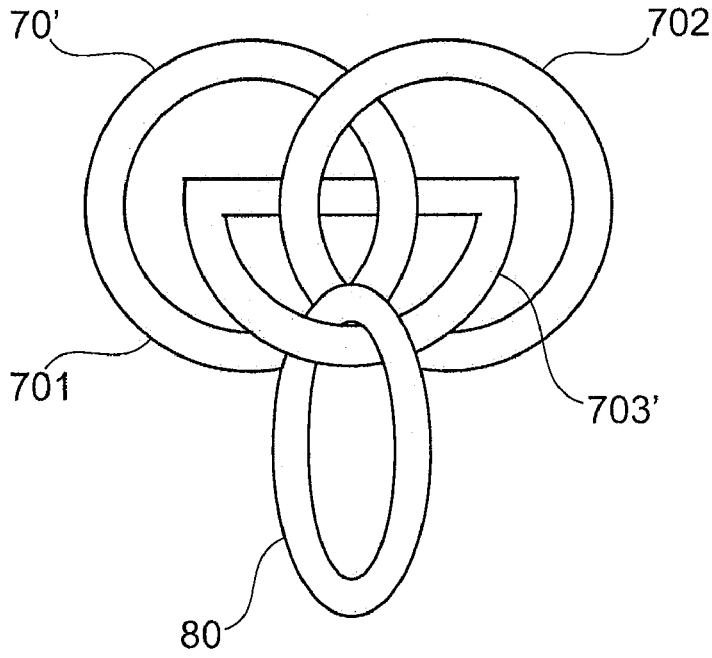
FIGS. 12*a* and 12*b* show three-dimensional views of connection elements.
Figure 12B:
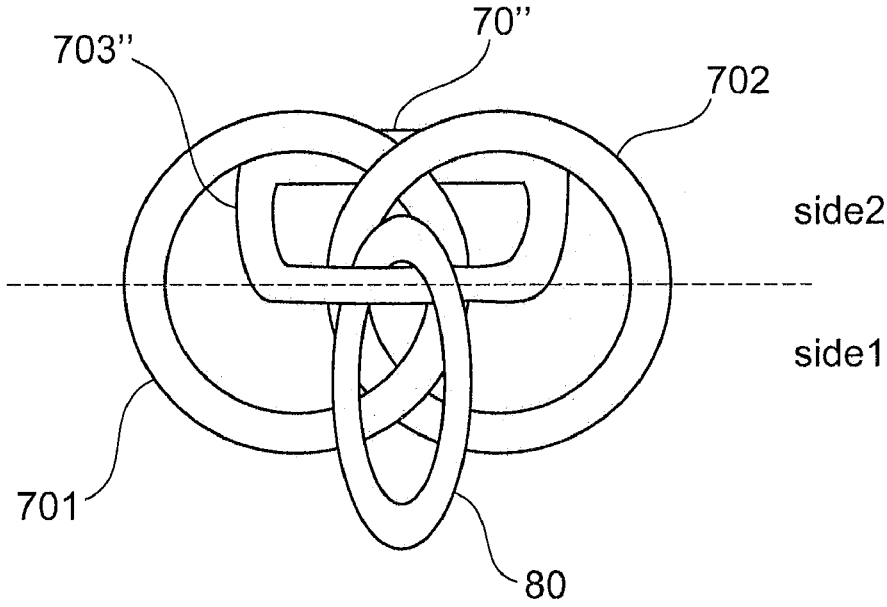

FIGS. 12*a* and 12*b* show two embodiments of the chain. The connection element 70' in FIG. 12*a* is constructed similarly as the connection element 70 in FIG. 8, but comprises four rings (701, 702, 703', and 80). A first ring (701) and a second ring (702) engage in one another arid a third ring (703') engages in both rings (701, 702). The first ring (701) and the second ring (702) are shaped like links of the chain elements and are solidly connected to one another at at least one point in such a way that they stand in relation to one another like a link (8, 30, 32, 34, 36) twisted to the right and a link (6, 20, 22, 24, 26) twisted to the left. The third ring (703') is shaped like a stirrup and hangs loosely in the rings (701 and 702). A fourth ring (80) is hung in the third ring (703').

The connection element 70" in FIG. 12*b* is constructed similarly to the connection element 70' in FIG. 12*a* and comprises four rings (701, 702, 703", and 80). A first ring (701) and a second ring (702) engage in one another and a third ring (703") engages in both rings (701, 702). The first ring (701) and the second ring (702) are shaped like links of the chain elements and are solidly connected to one another at least one point in such a way that they stand in relation to one another like a link (8, 30, 32, 34, 36) twisted to the right and a link (6, 20, 22, 24, 26) twisted to the left. The third ring (703") is shaped like a stirrup and is solidly connected to the rings (701, 702) at its linear side on the side 2 of the connection element. The corners on the linear side of the stirrup are preferably rounded, and the originally linear partial element of the stirrup-shaped ring (703") presses closely against the other two rings (701, 702). In this embodiment, the third ring (703") is also shaped in such a way that the links of the chain elements (2 and 4), in which the ring (703") engages, in the configuration of the chain elements (2 and 4) in the twisted state, come into contact as much as possible, preferably precisely in one plane and under tensile stress at an angle of 90°, with this ring (703"). This is preferably achieved by corresponding bending of the stirrup-shaped ring (703"). Preferably, the ring (703") has its rounded end bent away from the connection element, i.e., bent upward out of the plane of the drawing in FIG. 12, the center of gravity of the connection element (70") is thus additionally displaced toward the side 2. A fourth ring (80) is hung in the third ring (703"). The connection element is preferably heavier on the side 2 than on the side 1 in this form.

The chains which have a weight in the middle are hung in the curb in such a way that the weight acts against twisting and/or tilting in the twisted state. Preferably, the chain is hung in such a way that the end of the chain element twisted to the right is hung from the inside in the right hook of the curb viewed from the horse and the end of the chain element twisted to the left is hung from the inside in the left hook of the curb viewed from the horse. In the twisted state, the ring is on the side of the chain pointing away from the horse or hangs downward. The chain may also be hung in such a way that the end of the chain element twisted to the right is hung from the outside in the left hook of the curb viewed from the horse and the end of the chain element twisted to the left is hung from the outside in the right hook of the curb viewed from the horse. A laterally attached ring is then on the side of the chain facing away from the horse in the twisted state.

Figure 13:
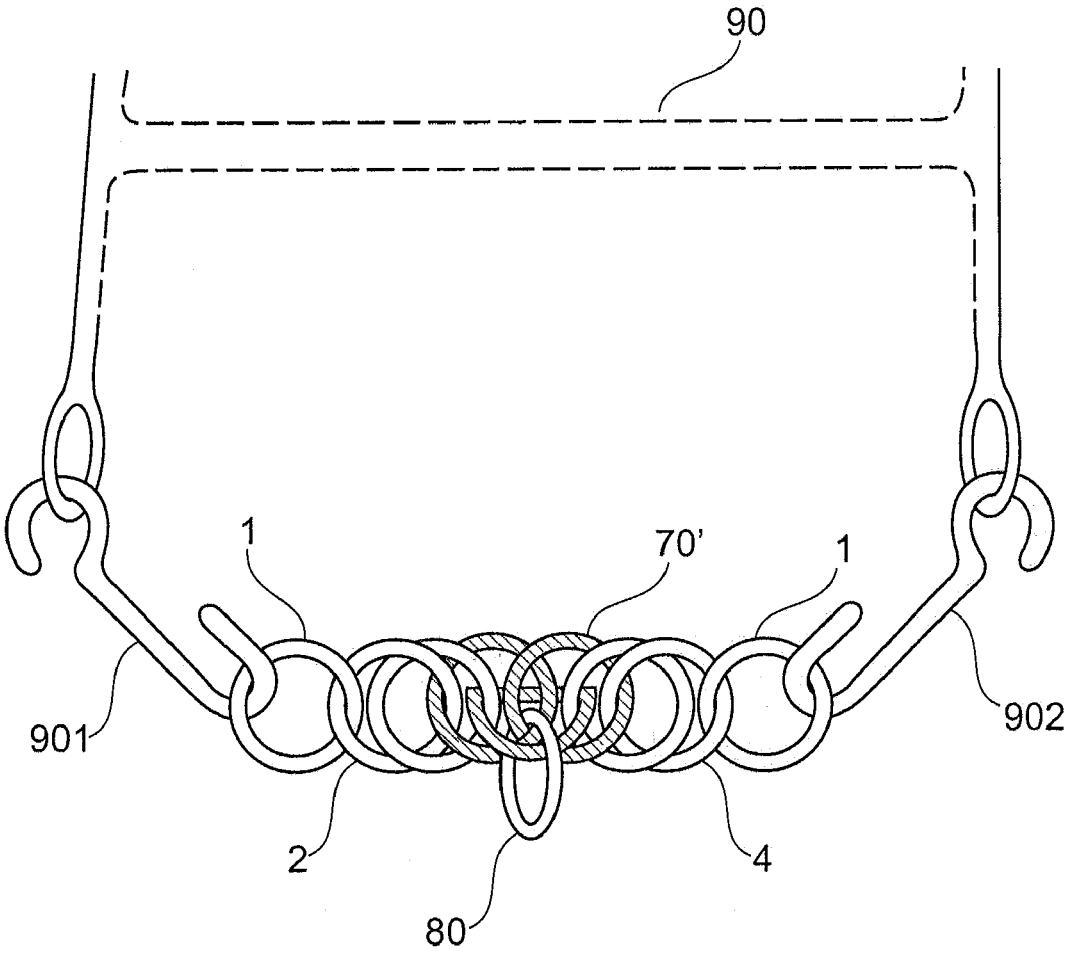
FIG. 13 schematically shows a chin chain, which is hung in a schematically illustrated curb.

FIG. 13 indicates a curb 90 and schematically illustrates how the chain is preferably to be hung. It is to be noted here that only a very short chain is indicated, the number of the chain links is not to be illustrated realistically. The position of the indicated curb rod to the chain also does not correspond to the position in the mouth of the horse. In a further embodiment the two-part chain is secured against twisting toward the open side from the group consisting of a wire braid, a wire, a cable, or a thread, which is alternately guided above and below the links of the chain.

In a further embodiment, at least two two-part chains are linked to one another longitudinally, so that a chain element twisted to the right of a first chain is longitudinally linked to a chain element twisted to the left of a second chain in each case. Tilting and twisting is thus also prevented. In a further embodiment, at least two one-part chains are linked to one another longitudinally, such that a right-hand chain is longitudinally linked to a second left-hand chain. Tilting and twisting is thus also prevented.

As described above, the chain may be used as a chin chain for bridles; for example, for curb bridles. The chin chain may also be used for dressage horses as well as for draft horses, which pull a wagon. The chin chain may, if it has no ring 80 for weighting, nonetheless contain a light ring preferably manufactured from plastic in the form of a lip strap ring. In this use, the chain preferably has a width of 1.5 to 2.0 cm, more preferably 1.7 to 1.9 cm, and most preferably 1.9 cm.

According to a further example, a chain twisted to the left is used for producing jewelry, such as bracelets, necklaces, or watch straps. Furthermore, an at least two-part chain is used for producing jewelry, such as bracelets, necklaces, or watch straps. In addition, an at least two-part chain is used as force-transmitting means, except for in a curb, to ensure uniform force transmission on both sides. Furthermore, an at least two-part chain is used as force-transmitting means in a machine to ensure uniform force transmission on both sides. Each of the chains described above may also be used in this context for jewelry and as force-transmitting means. Alternative combinations and variations of the examples provided will become apparent based on this disclosure. It is not possible to provide specific examples for all of the many possible combinations and variations of the embodiments described, but such combinations and variations may be claims that eventually issue.

The invention claimed is:

1. A chain, comprising:

a first chain element twisted to the left comprised of a plurality of first links, each of the plurality of first links having a first twisted shape planarly engaging a number of following links of the plurality of first links;

a second chain element twisted to the right comprised of a plurality of second links, each of the plurality of second links having a second twisted shape planarly engaging a number of following links of the plurality of second links;

a connection means for joining the first chain element to the second chain element, such that the connection means engages the same number of following links of the plurality of first links as are engaged by each of the plurality of first links, and the connection means engages the same number of following links of the plurality of second links as are engaged by each of the plurality of second links.

2. The chain according to claim 1, wherein the number of following links for both of the plurality of first links and the plurality of second links is two second links and the connection means engages the first two of the plurality of first links of the first chain and the first two of the plurality of second links of the second chain.

3. The chain according to claim 1, wherein the connection means comprises three rings;

a first ring engages in at least one of the plurality of first links and has the shape of the plurality of first links and is rigidly connected at at least one point to a second ring, the second ring engages in at least one of the plurality of second links and has the shape of the plurality of the second links, and a third ring engaging in both the first and second rings and in one of the plurality of first links and one of the plurality of second links.

4. The chain according to claim 3, wherein the third ring is rigidly connected to the first ring and the second ring at four points.

5. The chain according to claim 3, wherein the first ring and the second ring are connected to one another such that a forth ring is disposed between the two connection points of the first ring and the second ring.

6. The chain according to claim 3, wherein the a third ring is shaped like a stirrup and is not solidly connected to the other two rings of the connection means, and a fourth ring is hung in the stirrup-shaped third ring; and one of the plurality of first links and one of the plurality of second links engages the stirrup-shaped ring.

7. The chain according to claim 6, wherein the third ring is shaped like a stirrup and is rigidly connected at a linear side of the third ring disposed at a side of the connection means and has a round end of the third ring bent away from the connection element such that the one of the plurality of first links and the one of the plurality of second links, in which the third ring engages, seats in the configuration of the chain elements in the twisted state in a plane and under tensile stress at an angle of 90° to the third ring.

8. The chain according to claim 1, further comprising another ring attached to the connection means as a weight.

9. The chain according to claim 1, wherein the connection means weighs more on one side of the connection means than on an opposite side of the connection means.

10. The chain according to claim 1, wherein the chain is secured against twisting toward an open side by a securing device selected from the group consisting of a wire braid, a wire, a cable, and a thread guided above and below the links of the chain alternatingly.

11. A chain comprising:

a first chain element twisted to the left comprised of a plurality of first links, each of the plurality of first links having a first twisted shape planarly engaging a number of following links of the plurality of first links;

a second chain element twisted to the right comprised of a plurality of second links, each of the plurality of second links having a second twisted shape planarly engaging a number of following links of the plurality of second links;

a connection means for joining the first chain element to the second chain element, such that the connection means engages the same number of following links of the plurality of first links as are engaged by each of the plurality of first links, and the connection means engages the same number of following links of the plurality of second links as are en a ed by each of the plurality of second links, wherein the connection means consists of a first ring and a second ring rigidly connected to one another; wherein the first ring engages the first chain, element and has a shape twisted to match the plurality of first links of the first chain element, the second ring engages the second chain and has a shape twisted to match the plurality of second links.

12. The chain according to claim 11, wherein the connection means is designed such that the first ring and the second ring are rigidly connected to one another at two connection points and are joined with one another at the two connection points.

13. A chain comprising:

a first chain element twisted to the left comprised of a plurality of first links, each of the plurality of first links having a first twisted shape planarly engaging a number of following links of the plurality of first links;

a second chain element twisted to the right comprised of a plurality of second links, each of the plurality of second links having a second twisted shape planarly engaging a number of following links of the plurality of second links;

a connection means for joining the first chain element to the second chain element, such that the connection means engages the same number of following links of the plurality of first links as are engaged by each of the plurality of first links, and the connection means engages the same number of following links of the plurality of second links as are engaged by each of the plurality of second links, wherein the connection means comprises an oval and a round ring fitted into the oval.

14. The chain according to claim 13, wherein the connection means is shaped from a ring which, by twisting 180°, forms a large oval loop and a smaller round loop, which are laid one on top of another so that the smaller round loop comes to rest largely above the large oval loop.

15. The chain according to claim 13, wherein the round ring and the oval are rigidly connected to one another in at least one point.

16. The chain according to claim 13, wherein the connection means is designed such that the overlaps and connection points are joined with one another.

* * * * *